US006049683A

United States Patent [19]

Liu et al.

[11] Patent Number: 6,049,683

[45] Date of Patent: Apr. 11, 2000

[54] ELECTROSTATIC PRINTING METHOD AND APPARATUS HAVING ENHANCED CUSTOM COLOR CHARACTERISTICS

[75] Inventors: Chu-heng Liu, Penfield; Weizhong Zhao, Webster, both of N.Y.

[73] Assignee: Xerox Corporation, Stamford, Conn.

[21] Appl. No.: 09/233,083

[22] Filed: Jan. 19, 1999

[51] Int. Cl.[7] ..... G03G 15/10

[52] U.S. Cl. ..... 399/237; 399/238; 399/239; 399/249

[58] Field of Search ..... 399/237–240, 399/246, 249; 430/100, 117

[56] References Cited

U.S. PATENT DOCUMENTS 4,267,556 5/1981 Fotland et al. .
4,761,357 8/1988 Tavernier et al. ..... 430/32
4,885,220 12/1989 Kuhman et al. .
5,596,396 1/1997 Landa et al. .
5,610,694 3/1997 Lior et al. ..... 399/240
5,619,313 4/1997 Domoto et al. .
5,781,828 7/1998 Caruthers, Jr. et al. .
5,987,283 11/1999 Zhao et al. ..... 399/327

*Primary Examiner*—Matthew S. Smith
*Attorney, Agent, or Firm*—Oliff & Berridge, PLC

[57] ABSTRACT

An apparatus and method provide improved custom color capabilities. A pre-mixed custom color toner having a high solids content of approximately 10–50% is used to generate a custom color toner layer to develop an electrostatic latent image. In contrast to conventional liquid developing systems, a complex control system is not needed to achieve consistent and stable color toner images using the invention. A custom color toner layer assembly can also be formed and used to develop an electrostatic latent image. Because the color and density of the toner layer assembly is formed before image development, color correction steps can be avoided.

26 Claims, 2 Drawing Sheets

ELECTROSTATIC PRINTING METHOD AND APPARATUS HAVING ENHANCED CUSTOM COLOR CHARACTERISTICS

BACKGROUND OF THE INVENTION

1. Field of Invention

This invention generally relates to electrostatic printing apparatus and methods of electrostatic printing. In particular, the invention relates to methods and apparatus for enhancing the custom color capabilities of an electrostatic printing apparatus.

2. Description of Related Art

Electrostatographic printing is well known and commonly used for copying or printing documents on a paper substrate. Electrostatographic printing is performed by forming a substantially uniform charge on a photoconductive member and exposing the photoconductive member to a pattern of light. Exposing the photoconductive member to the pattern of light generates a corresponding electrostatic latent image on the photoconductive member. Toner particles are then deposited onto the photoconductive member so that the toner particles are selectively deposited in either charged or discharged areas on the photoconductive member. The developed toner image is then typically transferred to a substrate and fixed to the substrate by heat and/or pressure. The photoreceptor is then cleaned of any residual toner or electric charge in preparation for another charge/electrostatic latent image generating/development process.

Electrostatographic printing systems typically develop an electrostatic latent image using solid toner particles either in powder form or suspended in a liquid carrier. In liquid developing systems, the liquid developer typically has about two percent by weight toner material distributed in the liquid carrier. An electrostatic latent image is developed by applying the liquid developer to the photoconductive member, whereby the toner particles are selectively attracted to the surface of the photoconductive member in accordance with an electrostatic latent image.

Conventional liquid printing systems, such as liquid immersion development (LID) systems, can generate custom colors by combining two or more primary color toners before depositing the toners and then using the mixed toner to develop an electrostatic latent image. However, due to the differences in physical and chemical properties of the toners of different colors and other factors, a sophisticated feedback scheme must be used to obtain accurate color reproduction and color stability. For example, the differential mobility of the mixed toners often results in different consumption rates of different toner during development, requiring complex color control techniques to maintain a desired composition, e.g. color, of the toner and the color and density of the toner image created.

The on-demand custom color capability of electrostatographic printing systems may vary significantly due to numerous conditions affecting image development, among various factors, including but certainly not limited to the methods and apparatus used to mix the primary colors to achieve the desired custom color and the process controls implemented on the color mixing and development subsystems to maintain the color accuracy and stability. In general, a number of primary color developers are mixed in a reservoir with certain proportions according to the customer selection and the consumption rate of the primary colors, and then the developer mixture is applied to the latent image for development. Examplary patents which may describe certain general aspects for achieving customer selectable colors, as well as specific apparatus therefor, may be U.S. Pat. No. 5,781,828 to Caruthers et al., as well as other patents cited therein.

The relevant portions of the foregoing patent may be briefly summarized as follows:

U.S. Pat. No. 5,781,828 discloses a system and method for color mixing management in an electrostatographic printing system, wherein a developing material reservoir containing an operative solution of colored developing material including a mixture of selected color components is continuously replenished with selected differently colored developing material concentrates in a predetermined ratio so as to be capable of producing a customer selectable color image area on an output substrate. The system may also be used to mix a customer selectable color in situ, either from stored proportions known to compensate for developability differences or from approximate amounts of primary color components initially deposited and mixed in the developing material reservoir with the resultant operative developing material mixture continually developed and replenished with a predetermined ratio of color components until the developing material mixture reaches a steady state color.

SUMMARY OF THE INVENTION

The invention provides an image forming system and method that pre-mixes toner of different colors to form a pre-mixed custom color ink that has a relatively high solid content of approximately 15–50%. The pre-mixed custom color ink is then used to develop an electrostatic latent image and/or is applied to a support in preparation for generating a toner image.

In one aspect of the invention, a voltage bias is used to transfer custom color ink to a support.

In one aspect of the invention, no voltage bias is used to transfer custom color ink to a support.

In one aspect of the invention, supply limited development techniques are used to develop an electrostatic latent image. Thus, color stability is maintained and no color correction is needed because the composition of the toner used to develop the image is the same before and after development.

The invention also provides an image forming system and method that form a custom color toner layer from a custom color toner mixture and use this toner layer to develop an electrostatic latent image.

In one aspect of the invention, the entire toner mass of the toner layer corresponding to the image area is used to develop the image.

In one aspect of the invention, the toner layer has a relatively high solid content of 10–50%.

In one aspect of the invention, the custom color mixture is formed by mixing the primary color toners at a lower concentration of approximately less than 20% solid.

In one aspect of the invention, the custom color toner layer assembly is created by applying pre-mixed ink having different color toners to a support and compacting the toner and removing fluid from the toner.

In one aspect of the invention, an entire thickness of the custom color toner layer assembly is used to develop the electrostatic latent image.

In one aspect of the invention, a portion of the thickness of the custom color toner layer assembly is used to develop the electrostatic latent image.

BRIEF DESCRIPTION OF THE DRAWINGS

The invention will be described in relation to the following drawings in which reference numerals refer to like elements, and wherein.

DETAILED DESCRIPTION OF PREFERRED EMBODIMENTS

This invention relates, in part, to contact electrostatic printing (CEP), which is similar to, but not identical to, other forms of electrostatographic printing, such as powder or LID systems. Some of the hallmarks of a CEP system include:

(a) a liquid toner medium that has a relatively high solid content (approximately 10–50% solids), which is 5 to 25 times higher than the liquid developing medium typically used in LID; and (b) limited relative movement between toner particles during and after latent image development, i.e. the relatively high solid content of the toner prevents toner particles from moving relative to each other, unlike that in other liquid developing mediums, and the liquid carrier in the toner serves to bind the toner particles together as a single mass, unlike the individual toner particles in powder developing systems.

Contact electrostatic printing (CEP) works similarly to other electrostatic printing methods that use liquid or solid toner. Therefore, several of the elements of a CEP apparatus are similar to, if not the same as, corresponding elements in the conventional liquid and/or solid toner electrostatic printing systems. Such elements include photosensitive drums, cleaning apparatus, charging devices and associated control systems. Accordingly, since these elements are well known, only differences between elements as used in the CEP apparatus of the invention and the corresponding elements of the conventional systems are described below.

Figure 1:
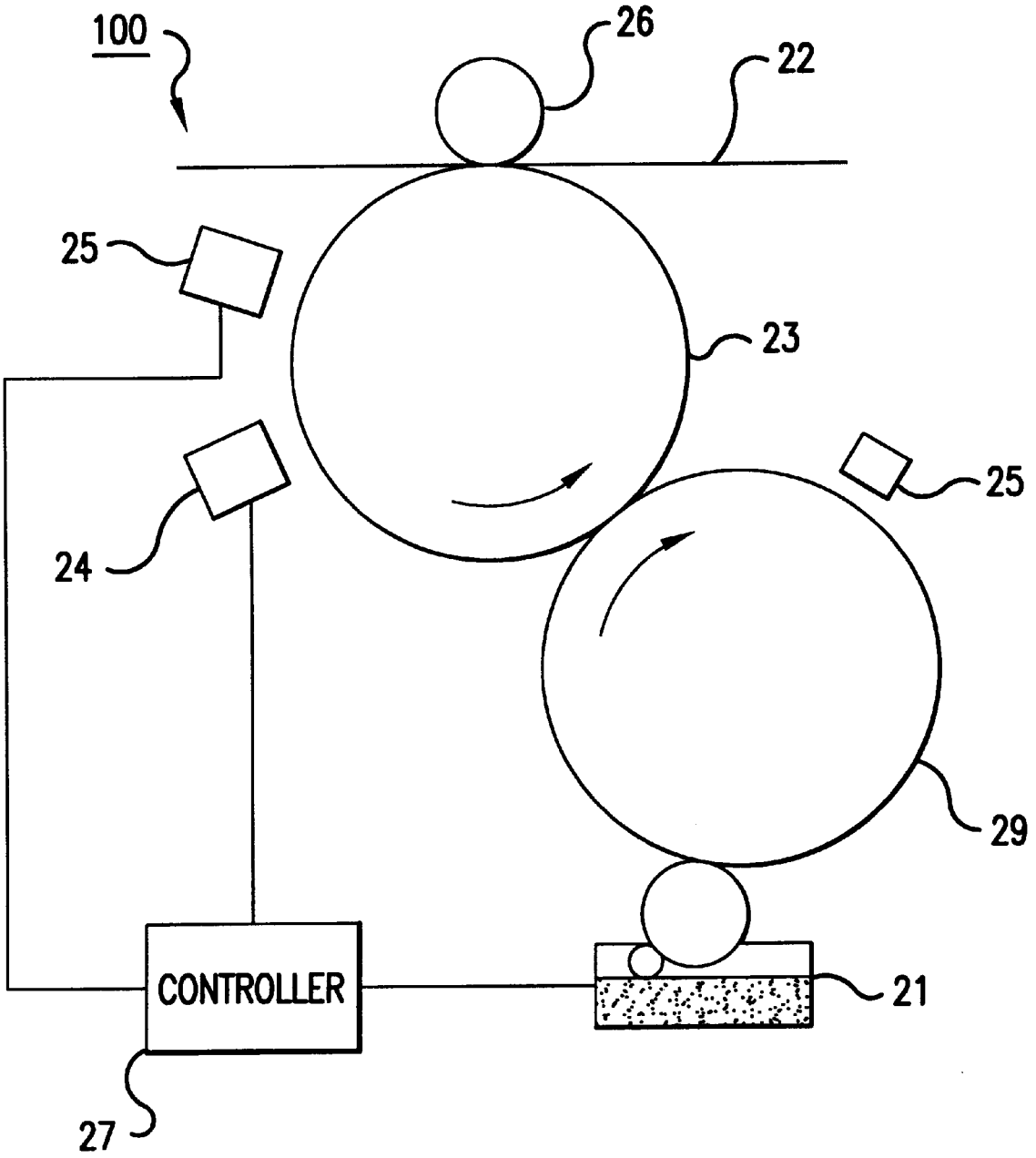
FIG. 1 is a schematic diagram of a first embodiment of a printing apparatus in accordance with the invention.

FIG. 1 is a schematic diagram of a first printing apparatus 100 in accordance with the invention. A toner applicator 21 contains a pre-mixed ink having a relatively high solid content of approximately 15–50%. The pre-mixed ink includes at least two different color toners to form a custom color. For example, the pre-mixed ink could include blue and yellow toners to form a custom color ink having a green appearance. The ink is pre-mixed in a fluidized mixing tank (not shown) that includes a sensor for color control and solids control. Color and solids control is performed by a controller 27 that receives input from sensors in the mixing tank and provides control signals to the toner applicator 21. Although the ink is preferably pre-mixed in the mixing tank, pre-mixed custom color ink could be supplied to the toner applicator 21.

Using the pre-mixed custom color ink, the toner applicator 21 forms a layer of custom color toner on a toner support 29. The toner applicator 21 can use electrostatic properties of the ink to form the toner layer on the toner support 29, or apply the ink the toner support 29 without using a voltage bias. If the toner applicator 21 uses a voltage bias to apply the ink to the toner applicator 21, the toner applicator 21 can be controllable to deposit patches of varying size, shape and density on the toner support 29, as described in co-pending application Ser. No. 09/232,642, which is incorporated herein by reference. However, the toner applicator 21 could deposit a continuous layer of toner on the toner applicator 21.

One voltage bias free method for applying ink to the toner support 29 is gravure roll coating. Applying the ink without using a voltage bias has the advantage of ensuring that differential consumption of the toner does not occur, e.g. one type of toner in the ink will not be deposited on the toner support 29 at a higher rate than another type of toner due to the differences in the electrostatic properties among the constituent particles. However, because the custom color ink has a relatively high solids content, mobility of toner within the ink is limited and even ink application methods that use a voltage bias will not suffer at all or significantly from differential consumption problems. Since differential consumption problems are avoided using the invention, complex sensing and control devices like that found in conventional LID systems are not needed to ensure that the custom color ink maintains a desired color and/or solids content.

As the toner support 29 rotates as shown in FIG. 1, the toner layers on the outer surface of the toner support 29 are acted upon by an electrostatic charge pattern, i.e., a latent image, formed on a photoreceptor 23. The electrostatic charge pattern is generated on the photoreceptor 23 by an electrostatic charge pattern generator 24 in a known manner. Preferably, the electrostatic charge pattern generator 24 includes a charging device, such as a corotron, scorotron or roller that charges a photosensitive outer surface of the photoreceptor 23 to a desired voltage level. The electrostatic charge pattern generator 24 also preferably includes a light source, such as a laser, that illuminates selected portions of the charged surface of the photoreceptor 23 to thereby discharge the selected portions. The resulting charge pattern corresponds to or otherwise represents a desired image, such as an image scanned from a paper document or created using another imaging or image generating device, such as a camera or computer paint or draw application.

The electrostatic charge pattern on the photoreceptor 23 operates to selectively remove portions of the toner on the toner support 29. Preferably, supply limited development techniques are used to develop the electrostatic charge pattern. That is, toner in a toner layer that is acted on by an electrostatic charge pattern is either substantially entirely transferred to the photoreceptor or substantially entirely remains on the toner support 29. Thus, although development is dependent on the electrostatic charge pattern, the color and density of the developed image is not dependent on the charge pattern and instead is determined by the color and density of the toner on the toner support 29. Toner portions transferred to the photoreceptor 23 represent a developed toner image that is preferably transferred to a final surface 22, such as a paper substrate, by a transfixing device 26. The transfixing device 26 transfers the toner image on the toner support 29 to the final surface using any one of known techniques, including pressure, heat and/or an electrical charge differential. Residual toner left on the toner support 29 or the photoreceptor 23 is removed by cleaning devices 25. The cleaning devices can include a scraping blade and/or a sponge roller and/or other known devices for removing residual toner and any remaining electrical charge on the toner support 29 and/or the photoreceptor 23.

The toner applicator 21 and the electrostatic charge pattern generator 24 are preferably controlled by the controller 27. However, the controller 27 can control the operation of and/or receive information from other elements in the apparatus 100, such as the cleaning devices 25, the transfixing device 26, the toner support 29 and/or the photoreceptor 23. In addition, the controller 27 need not control the operation of the toner applicator 21 if the toner applicator 21 is not controllable to deposit toner patches of varying size and shape on the toner support 29.

The controller 27 preferably includes a general purpose computer that is programmed and has appropriate circuitry to supply the appropriate control signals to the control elements of the apparatus 100. The controller 27 can also be implemented, at least in part, as a single special purpose integrated circuit (e.g., ASIC) or an array of ASICs, each having a main or central processor section for overall, system-level control, and separate sections dedicated to performing various different specific computations, functions and other processes under the control of the central processor section. The controller 27 can also be implemented using a plurality of separate dedicated programmable integrated or other electronic circuits or devices, e.g., hardwired electronic or logic circuits such as discrete element circuits or programmable logic devices. The controller 27 also preferably includes other devices, such as volatile or non-volatile memory devices, communications devices, relays, motors, mechanical linkages, and/or other circuitry or components necessary to perform the desired input/output or other functions.

In the FIG. 1 printing apparatus 100, there preferably is no image conditioning after toner layer application. That is, there is no device or other processing to remove fluid from a deposited toner layer. Normally, such image conditioning is performed to avoid any color contamination or ink poisoning problems that occur or may occur when toners mix or are near each other. Image conditioning removes liquid from the deposited toner layers, thereby decreasing the toner particle mobility and ability of the toner layer to mix with subsequently deposited toner layers. However, since the toners have a relatively high solid content when applied to the toner support 29, image conditioning is probably not required in most circumstances.

Because the toner layer on the toner support 29 has a relatively high solid content, additional toner applicators 21 can be used to deposit additional toner layers on the toner support that at least partially overlap other toner layers on the support, as described in co-pending application Ser. No. 09/232,642. However, additional toner applicators 21 are not required.

The apparatus 100 could be optionally equipped with a color correction device that senses the color and density of toner layers on the toner support 29 and makes fine adjustments to the toner color and/or density by adjusting the mix of ink in the toner applicator 21 or by controlling other toner applicators 21 to apply toners of other colors to the custom color toner layer. For example, the color correction device could detect that a deposited custom color toner is not red enough and control the apparatus 100 to deposit red toner on the custom color toner layers to achieve the desired color. The color correction device preferably includes a color image sensing device, e.g. CCD imager, and associated circuitry and software modules, if necessary, to evaluate the detected color and output appropriate control signals to adjust the apparatus 100 operation.

In addition, although the printing apparatus 100 is described as transferring a toner image from the photoreceptor 23 to a final surface 22, the toner on the toner support 29 could be transferred to a final surface 22. That is, the photoreceptor 23 could operate to remove background portions of the toner image from the toner support 29, leaving a toner image on the toner support 29.

Figure 2:
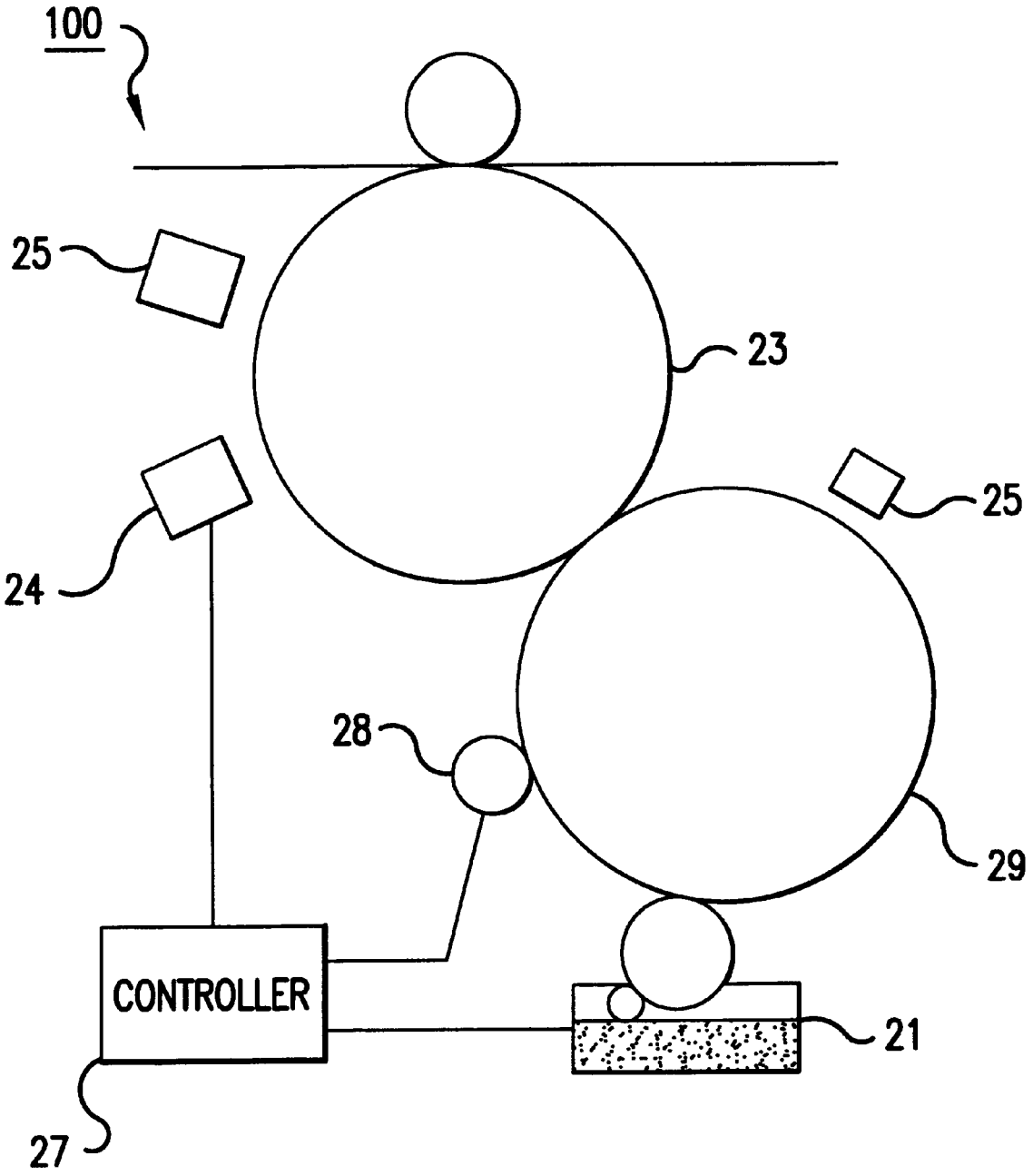
FIG. 2 is a schematic diagram of a second embodiment of a printing apparatus in accordance with the invention.

The apparatus 100 shown in FIG. 2 is only one example of an image forming system in accordance with the invention where toner is applied to the toner support 29 and then acted on by a photoreceptor 23. However, other configurations are possible where a custom color toner layer or toner layer assembly is formed, and then used to develop an electrostatic charge pattern.

For example, FIG. 2 shows a second printing apparatus 100 in accordance with the invention. In this embodiment, a toner applicator 21 contains a pre-mixed custom color ink that includes two or more different color toners. As in the FIG. 1 apparatus 100, the ink is mixed in a mixing tank (not shown) and the color and solids content of the ink is controlled by the controller 27. However, in the FIG. 2 apparatus 100, the pre-mixed ink does not necessarily have a high solids content. It has been found that better mixing can be achieved at lower solid content. Thus, the pre-mixed ink can have a relatively low solids content, such as that found in conventional LID systems (i.e., 2–10% solids). Preferably, the toner applicator 21 applies the pre-mixed ink to the toner support 29 using a voltage bias free application method, such as gravure roll coating. Thus, since the toner application process is not voltage dependent, differential consumption problems are avoided. However, the toner applicator 21 could use a voltage bias to apply the toner to the toner support 29, and if so, differential consumption problems like those found in conventional LID systems should be taken into account regarding the toner mixing process.

After ink is applied to the toner support 29, a roller or squeegee 28 removes fluid and compacts the toner to form a toner layer having a relatively high solids content. Such devices that simultaneously compact and remove fluid from a toner image are known in the art and are described, for example, in U.S. Pat. No. 5,276,492. These devices typically carry a voltage bias opposite in polarity to the polarity of the charge, if any, on the toner so that the toner is compacted. For example, fluid can be removed by a porous roller absorbing excess fluid, or by a metering roller, as are known in the art. Thus, after the toner is compacted and fluid is removed, a layer of toner very similar to that formed in the FIG. 1 apparatus 100 is formed on the toner support 29.

An electrostatic latent image on the photoreceptor 23 acts on the toner layer on the toner support 29. Preferably, supply limited development techniques are used to develop the electrostatic latent image. However, a form of supply limited development where the toner layer on the toner support 29 is split in a direction parallel to the surface of the toner support 29 can be used to develop the electrostatic latent image. In either process, complex color correction techniques are not required because the density and color of the toner image formed on the photoreceptor 23 (or the toner support 29) depends on the density and color of the toner layer on the toner support 29, not the development potential on the photoreceptor 23.

So far, a development system with a high solid content toner layer as its input has been described. Alternatively, the optional fluid removal device 28 can be omitted and the low solid content toner layer is supplied to the development subsystem directly. Substantial improvement over conventional LID development can be made when a supply limited development is used where the toner mass in the toner layer is used to near completion to develop the image area of a latent image. While the invention has been described with the specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An image forming apparatus comprising:

at first toner applicator that applies a pre-mixed custom color toner to a support;

a second toner applicator that applies a non-custom color toner to the support;

an image support; and a charge pattern generator that generates an electrostatic charge pattern that is used to operate on the toner to create a toner image on the image support.

2. The apparatus of claim 1, wherein at least one of the toner applicators uses a voltage bias to apply toner to the support.

3. The apparatus of claim 1, wherein at least one of the toner applicators does not use a voltage bias to apply toner to the support.

4. The apparatus of claim 3, wherein at least one of the toner applicators applies toner using a gravure roll process.

5. The apparatus of claim 1, wherein supply limited techniques are used to develop the electrostatic charge pattern.

6. The apparatus of claim 1, further comprising a photoreceptor that contacts the support, wherein at least one of the toner applicators deposits a custom color toner layer on the support and the custom color toner layer is acted on by an electrostatic charge pattern formed on a photoreceptor.

7. The apparatus of claim 1, wherein the first toner applicator deposits a custom color toner layer on the support, and the custom color toner layer is acted on by an electrostatic charge pattern on the image support.

8. The apparatus of claim 1, further comprising a toner conditioner that removes excess liquid from a toner layer, wherein the first toner applicator deposits a custom color toner layer on the support, and the custom color toner layer is acted on by an electrostatic charge pattern on the image support.

9. The apparatus of claim 1, wherein the electrostatic charge pattern is generated on the support before at least one toner layer is applied to the support.

10. The apparatus of claim 1, wherein the custom color toner has a high solid concentration of 10–50%.

11. An image forming apparatus comprising:

an image support;

at least one toner applicator that applies a pre-mixed ink containing at least two different types of toner to a support without using a voltage bias;

a toner conditioner that removes fluid from and compacts the toner applied to the support to form a custom color toner layer; and a charge pattern generator that generates an electrostatic charge pattern that is used to operate on the custom color toner layer to create a toner image on the image support.

12. The apparatus of claim 11, wherein the toner applicator applies toner using a gravure roll process.

13. The apparatus of claim 11, wherein supply limited techniques are used to develop the electrostatic charge pattern.

14. The apparatus of claim 11, wherein the ink applied to the support has a solids content of approximately 2–10%.

15. The apparatus of claim 11, further comprising at least one additional toner applicator that applies toner to the support.

16. The apparatus of claim 11, further comprising a photoreceptor, wherein the custom color toner layer is operated on by an electrostatic charge pattern on the photoreceptor.

17. The apparatus of claim 11, wherein the toner conditioner comprises one of a charged roller and a squeegee.

18. A method for forming a toner image comprising:

forming a custom color toner layer on a support, the custom color toner layer including at least two different types of toner;

forming a non-custom color toner layer on the support; and generating an electrostatic charge pattern that is used to operate on at least the custom color toner layer to create a toner image on an image support.

19. The method of claim 18, wherein the step of forming a custom color toner layer comprises:

applying a pre-mixed custom color ink to the support; and removing fluid from the ink and compacting the toner to form the custom color toner layer on the support.

20. The method of claim 18, wherein the step of forming a custom color toner layer comprises:

applying a pre-mixed custom color ink having a relatively high solids content to the support.

21. The method of claim 18, wherein the step of generating the electrostatic charge pattern comprises:

forming an electrostatic charge pattern on a photoreceptor; and positioning the electrostatic charge pattern in sufficient proximity to the support so that the electrostatic charge pattern selectively acts on the custom color toner layer on the support.

22. The method of claim 18, wherein the step of forming a custom color toner layer comprises:

forming the custom color toner layer to have a high solid concentration of 10–50%.

23. A toner image forming apparatus comprising:

toner layer forming means for forming a custom color toner layer on a support without using a voltage bias, the custom color toner layer including at least two different types of toner;

toner conditioning means for removing excess fluid from ink applied to the support and compacting toner to form the custom color toner layer; and electrostatic charge pattern generation means for generating an electrostatic charge pattern that is used to operate on the custom color toner layer to create a toner image on an image support.

24. The toner image forming apparatus of claim 26, wherein the toner layer forming means comprises:

a toner support; and a toner applicator that applies a pre-mixed custom color ink to the toner support to form the custom color toner layer.

25. The toner image forming apparatus of claim 24, wherein the pre-mixed custom color ink has a high solids content of approximately 10–50%.

26. The toner image forming apparatus of claim 24, wherein the pre-mixed custom color ink applied to the toner support has a solids content of approximately 2–10%.

* * * * *